US006091191A

United States Patent [19]

Togawa

[11] Patent Number: 6,091,191

[45] Date of Patent: Jul. 18, 2000

[54] EXPOSURE METHOD AND APPARATUS FOR PICTURE TUBE

[75] Inventor: Masaru Togawa, Shiga, Japan

[73] Assignee: NEC Corporation, Tokyo, Japan

[21] Appl. No.: 09/048,278

[22] Filed: Mar. 26, 1998

[30] Foreign Application Priority Data

Mar. 27, 1997 [JP] Japan ..... 9-075384

[51] Int. Cl.[7] ..... H01J 29/80

[52] U.S. Cl. ..... 313/402; 313/403; 313/407; 430/24

[58] Field of Search ..... 313/402, 472, 313/495, 465, 403, 407, 408, 422; 396/547; 430/24, 26

[56] References Cited

U.S. PATENT DOCUMENTS 3,953,621 4/1976 Donofrio ..... 430/24

FOREIGN PATENT DOCUMENTS 5-159716 6/1993 Japan .

*Primary Examiner*—Vip Patel
*Assistant Examiner*—Joseph Williams
*Attorney, Agent, or Firm*—Sughrue, Mion, Zinn, Macpeak & Seas, PLLC

[57] ABSTRACT

In an exposure method for a picture tube, photoresists which are applied on an inner surface of a panel are exposed through a shadow mask to fix the photoresists on the inner surface of the pane. A position where light, which is emitted by an exposure light source and passes through an outermost slot of the shadow mask, becomes directly incident on the inner surface of the panel, and a position where light, which is emitted by an exposure light source at the same position as that of the first exposure light source or at a different position from that of the first exposure light source, passes through a slot inside the outermost slot of the shadow mask, is reflected by an outer surface of the panel, and returns, becomes incident on the inner surface of the panel are set to coincide with each other. An exposure apparatus for achieving this method is also disclosed.

4 Claims, 3 Drawing Sheets

EXPOSURE METHOD AND APPARATUS FOR PICTURE TUBE

BACKGROUND OF THE INVENTION

1. Field of the Invention

The present invention relates to an exposure method and apparatus for a picture tube and, more particularly, to an exposure method and apparatus for a picture tube in which the adhesion strength of outermost photoresist stripes to the glass panel (to be merely referred to as a panel hereinafter) of the picture tube is improved.

2. Description of the Prior Art

FIG. 1 is a schematic view of an apparatus for explaining a conventional exposure method for a picture tube. FIG. 2 shows the screen of a picture tube formed with a photoresist matrix. In order to form photoresist stripes 11 on the inner surface of the picture tube, UV light 13 is irradiated from a light source 16 to a slurry layer of photoresists 15, containing a photosensitive material and applied on an inner surface 14*a* of a panel 14, to fix the slurry layer. The non-fixed portion of the slurry layer is washed off in a water washing step called a "development", and a fixed portion 15*a* forms the photoresist stripes 11 accordingly.

Therefore, as shown in FIG. 2, the photoresist stripes 11 corresponding to slots 12*a* of the shadow mask 12 are formed on the inner surface 14*a* of the panel 14. Since the adhesion strength of the photoresists 15 and the size of the photoresist stripes 11 depend on the intensity of incident light, consideration must be given to the light intensity distribution on the entire surface of the panel 14. According to the prior art, consideration is given mostly to the distribution of incident light by means of, e.g., a filter 17 arranged between the shadow mask 12 and the exposure light source 16.

In the conventional color picture tube, both the size and pitch of the photoresist stripes 11 to be formed are large. For example, a television picture tube employs a pitch equal to or larger than 0.4 mm. If, however, the prior art is applied to a high-definition picture tube, e.g., a recent monitor tube, inconveniences occur as follows. Right and left outermost photoresist stripes 11*a* of the screen tend to undesirably separate, and an entirely uniform photoresist screen cannot be formed. This suggests that the adhesion strength of the photoresists 15 onto the inner surface 14*a* of the panel 14 degrades as a whole because the photoresist matrix formed to meet the requirement for a higher definition is small, and that some specific state occurs only near the outermost stripes. Although this special state is supposed to have occurred in the conventional picture tube as well, it did not pose a problem in a low-definition picture tube.

FIG. 3 shows in detail the optical path during exposure in order to explain the object of the present invention. Hardening of the photosensitive photoresist slurry caused by exposure and adhesion of the photosensitive photoresist slurry onto the inner surface of the panel basically depend on the quantity of the incident UV light 13, as has been described in the prior art. Light which has passed through the slurry layer of the photoresists 15 and the panel 14 is reflected inward by an outer surface 14*b* of the panel 14 to irradiate the inner surface 14*a* of the panel 14, i.e., the adhesion surface between the panel 14 and photoresists 15, to promote the adhesion effect at this portion, thereby improving the adhesion effect.

After coming incident into the photoresists 15, the light becomes diffused light directed in the direction of incidence.

For the sake of simplicity, the passing light can be discussed separately as two light components, i.e., light 13*b* which becomes incident on the slurry layer of the photoresists 5 and is diffused, and light 13*a* which travels straight without being diffused. Considering the diffused light 13*b*, inside the periphery of the screen, light which is diffused from the peripheral portion of this inner portion overlaps the straight light 13*a*, and predetermined reflected light is ensured. On the outermost portion of the screen, since no light is diffused from the outside, the quantity of reflected light decreases sharply.

Regarding the light 13*a* which travels straight, although it is attenuated as it passes through the slurry layer of the photoresists 15, it is then refracted by the inner surface 14*a* of the panel 14 to become incident on the panel 14, and is reflected by the outer surface 14*b* of the panel 14 and is returned. The path of the return light does not necessarily coincide with the path of the incident light due to the position of the light source 16, the shapes of the shadow mask 12 and panel 14, and the positional relationship among the light source 16, the shadow mask 12, and the panel 14, but the return light lands on a point 15*b* which is outside an original incident point 15*a*. In particular, in the recent panel having a flat inner surface, the light which has passed through the outermost slot does not return along the same path.

Little light returns to the outermost photoresist stripe 11*a* of the panel corresponding to an outermost slot 12*a*1 of the shadow mask 12, and a sharp decrease in quantity of reflected light occurs at the outermost portion. This decreases the adhesion strength of the photoresist near the outermost portion, causing separation of the photoresist.

SUMMARY OF THE INVENTION

The present invention has been made in view of the problem of the conventional exposure method that considers only incident light, and has as its object to provide an exposure method and apparatus in which the path of reflected light is optimized and the quantity of light of photoresist stripes near the outermost portions is increased to improve the adhesion strength of photoresist stripes, so that separation of the photoresist is prevented.

In order to achieve the above object, according to the first aspect of the present invention, there is provided an exposure method for a picture tube of exposing, through a shadow mask, photoresists applied on an inner surface of a panel to fix the photoresists on the inner surface of the panel, comprising setting a position where light, which is emitted by an exposure light source and passes through an outermost slot of the shadow mask, becomes directly incident on the inner surface of the panel, to coincide with a position where light, which is emitted by an exposure light source at the same position as that of the first exposure light source or at a different position from that of the first exposure light source, passes through a slot inside the outermost slot of the shadow mask, is reflected by an outer surface of the panel, and returns, becomes incident on the inner surface of the panel.

According to the second aspect of the present invention, there is provided an exposure method for a picture tube according to the first aspect, wherein the position where the direct light and reflected light become incident on the inner surface of the panel is on an outermost photoresist stripe.

According to the third aspect of the present invention, there is provided an exposure apparatus for a picture tube in which a shadow mask is disposed between a panel, an inner surface of which is applied with photoresists, and an exposure light source, wherein a distance between the exposure light source and the inner surface of the panel, a gap between the shadow mask and the inner surface of the panel, a thickness of the panel, a refractive index of the panel, a horizontal pitch of the shadow mask, an opening angle of an outermost slot of the shadow mask with respect to a central axis connecting the exposure light source and a center of the panel, and the number, when counted from the outermost slot, of slots inside the outermost slot are set to satisfy a predetermined relationship, so that light which has passed through the outermost slot of the shadow mask and light which passes through the slot inside the outermost slot, is reflected by an outer surface of the panel, and returns, are set to coincide with each other on a position on the inner surface of the panel.

According to the fourth aspect of the present invention, there is provided an exposure apparatus for a picture tube according to the third aspect, wherein the exposure light source, the shadow mask, and the panel are disposed to satisfy:

$$Np = \left\{2(L-g)t / L\sqrt{n^2 - \sin^2\theta_0}\right\}\sin\theta_0$$

and $\theta_0 = \tan^{-1}\{\{(L-g)\tan\theta - Np\}/(L-g)\}$ where L is the distance between the exposure light source and the inner surface of the panel, g is the gap between the shadow mask and the inner surface of the panel, t is the thickness of the panel, n is the refractive index of the panel, p is the horizontal pitch of slots of the shadow mask, θ is the opening angle of the outermost slot of the shadow mask with respect to the central axis connecting the exposure light source and the center of the panel, and N is the number, when counted from the outermost slot, of slots inside the outermost slot.

As is apparent from the respective aspects described above, since light becomes incident on the outermost photoresist stripes from the front and rear sides, the quantity of light is increased, and the adhesion strength of the stripes is increased accordingly to prevent separation of the photoresists. As a result, high-definition, high-quality stripe-type picture tube can be provided.

In other words, since the exposure light that has passed through an inner slot reliably overlaps the outermost photoresist stripe portions, the outermost photoresist stripes are reliably fixed, and the outermost photoresists will not separate. Since light is superposed concerning the outermost stripes, the effect of superposing light can increase the adhesion strength up to a nearby inner stripe and that of the entire peripheral portion of the screen, so that uniform photoresist stripes can be formed on the entire screen. As a result, a high-definition, high-quality stripe-type picture tube can be manufactured.

The above and many other advantages, features and additional objects of the present invention will become manifest to those versed in the art upon making reference to the following detailed description and accompanying drawings in which preferred embodiments incorporating the principles of the present invention are shown by way of illustrative example.

DETAILED DESCRIPTION OF THE PREFERRED EMBODIMENT

According to the present invention, light which travels straight through the outermost slot and becomes incident on the inner surface of the panel and light which passes through a slot inside the outermost slot and is reflected by the outer surface of the panel are set to coincide with each other on the outermost photoresist stripe, so that the quantity of light on the outermost photoresist stripe is increased and the adhesion strength of the photoresist stripe is increased, thereby preventing separation of the photoresist. The principle of the present invention will be described with reference to FIG. 4.

Figure 1:
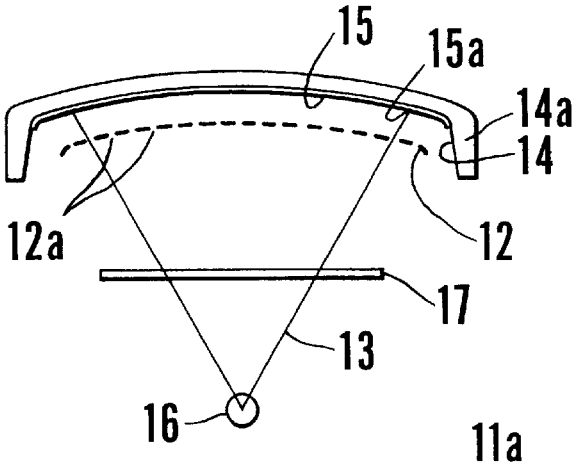
FIG. 1 PRIOR ART
FIG. 1 is a schematic view for explaining a conventional exposure method for a picture tube.
Figure 2:
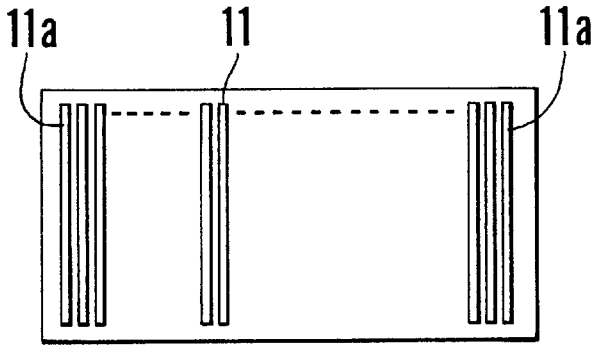
FIG. 2 PRIOR ART
FIG. 2 is a plan view of the light-emitting surface of a picture tube having photoresist stripes that are formed by the conventional exposure method for a picture tube.
Figure 3:
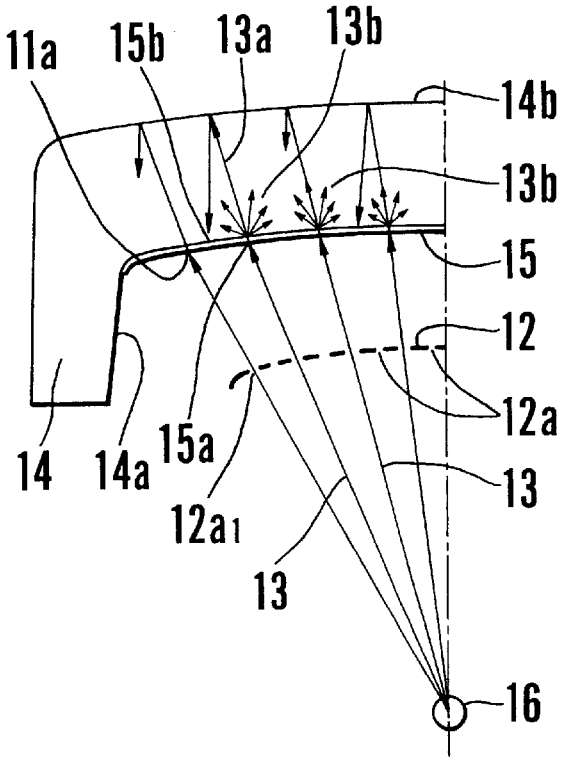
FIG. 3 PRIOR ART
FIG. 3 is a schematic view for explaining the path of exposure light in the conventional exposure method for a picture tube.
Figure 4:
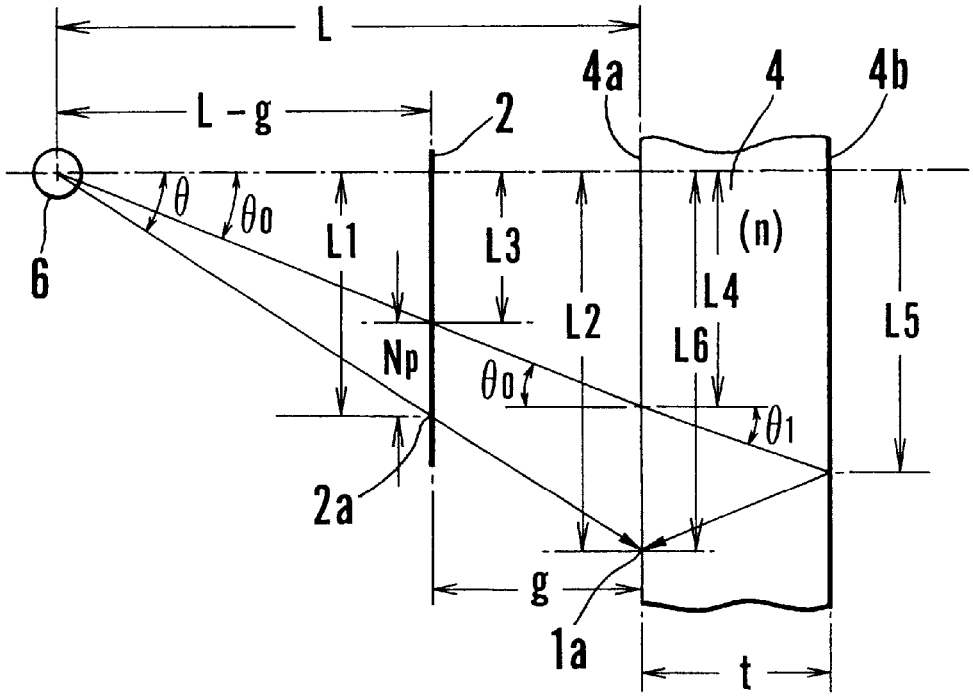
FIG. 4 is a schematic view for explaining the principle of an exposure method according to the present invention.

For the sake of descriptive simplicity, a case wherein the radius of curvature of the panel and that of the shadow mask are positive infinity will be described. FIG. 4 shows the respective portions of the picture tube during exposure with corresponding reference numerals. FIG. 4 shows an exposure light source 6 corresponding to, e.g., a green phosphor corresponded photoresist, a shadow mask 2, and a glass panel 4. The glass panel 4 has an inner surface 4*a* and an outer surface 4*b*. The outermost slot of the shadow mask 2 is denoted by reference numeral 2*a*, and the outermost photoresist stripe corresponding to this outermost slot 2*a* is denoted by reference numeral 1*a*. The dimensional relationship is as follows.

Assume that the horizontal pitch of the shadow mask 2 is defined as p, the distance between the exposure light source 6 and the central portion of the inner surface 4*a* of the panel 4 is defined as L, the gap between the shadow mask 2 and the inner surface 4*a* of the panel 4 is defined as g, the thickness of the panel 4 is defined as t, the refractive index of the panel 4 is defined as n, and the angle formed by a line connecting the outermost slot 2*a* of the shadow mask 2 and the light source 6 with respect to the center line of the panel 4 that passes through the light source 6 is defined as θ. Also assume that the position where light, which is emitted by the light source 6, passes through the outermost slot 2*a*, and becomes incident on the glass panel 4 is defined as 1*a*. When light, which is emitted by the same light source 6 and passes through an Nth slot inside the outermost slot 2*a*, is reflected by the outer surface 4*b* of the panel 4 to become incident on the outermost photoresist stripe (e.g., a green phosphor corresponded photoresist stripe) 1*a,* the incident light and the reflected light overlap each other at the position 1*a,* so that the quantity of light at the position la does not decrease sharply. The conditions for this are as follows.

From FIG. 4, an off-center distance (distance from the center line) L1 of the outermost slot 2*a* of the shadow mask 2 is expressed as:

$$L1 = (L-g)\tan\theta \quad (1)$$

An off-center distance L2 of the position where the light which has passed through the outermost slot 2*a* becomes incident on the inner surface 4*a* of the panel 4 is expressed as:

$$L2=L\tan\theta \tag{2}$$

A position L3 from the central axis of the Nth slot inside the outermost slot 2*a* is expressed as:

$$L3=(L-g)\tan\theta-Np \tag{3}$$

Accordingly, an off-center distance L4 of the position where the light which has passed through the Nth slot becomes incident on the inner surface 4*a* of the glass panel 4 is expressed as:

$$\begin{aligned} L4 &= L\cdot L3/(L-g) \\ &= L\{(L-g)\tan\theta-Np\}/(L-g) \end{aligned} \tag{4}$$

Assuming that the angle of incident with which the light which has passed through the Nth slot becomes incident on the inner surface 4*a* of the panel 4 is defined as $\theta_0$ and that the refractory angle is defined as $\theta_0$, they satisfy:

$$\sin\theta_0=n\sin\theta_1 \tag{5}$$

A reflecting position L5 on the outer surface 4*b* of the panel 4 is expressed as:

$$L5=L4+t\cdot\tan\theta_1 \tag{6}$$

A position L6 where the light which is reflected by the outer surface 4*b* of the panel 4 becomes incident on the inner surface 4*a* of the panel 4 is expressed as:

$$L6=L4+2t\cdot\tan\theta_1 \tag{7}$$

The condition required for setting the position where the light, which has passed through the outermost slot 2*a,* becomes directly incident on the inner surface 4*a* of the panel 4, and the position where the light, which is reflected by the outer surface 4*b* of the panel 4, becomes incident on the inner surface 4*a* of the panel 4, to coincide with each other are:

$$L2=L6 \tag{8}$$

Equations (2), (4), (7), and (8) concerning Np can be rewritten as follows:

$$Np=\{2(L-g)t/L\}\tan\theta_1 \tag{9}$$

Modification of $\tan\theta_1$ by using equation (5) yields:

$$\begin{aligned} \tan\theta_1 &= \sin\theta_1\Big/\sqrt{1-\sin^2\theta_1} \\ &= \sin\theta_0\Big/\sqrt{n^2-\sin^2\theta_2} \end{aligned} \tag{10}$$

Substitution of equation (10) into equation (9) yields:

$$Np=\left\{2(L-g)t/L\sqrt{n^2-\sin^2\theta_0}\right\}\sin\theta_0 \tag{11}$$

Note that $\theta_0$ is expressed as:

$$\begin{aligned} \theta_0 &= \tan^{-1}\{L3/(L-g)\} \\ &= \tan^{-1}\{\{(L-g)\tan\theta-Np\}/(L-g)\} \end{aligned} \tag{12}$$

From equations (11) and (12), Np is a function of L, θ, n, g, and t.

When the respective factors are determined to satisfy equations (11) and (12), light which has passed through the outermost slot 2a and light which passes through a slot inside the outermost slot 2*a* and is reflected by the outer surface of the panel to be returned can be caused to superpose each other on the outermost photoresist stripe. Hence, the quantity of light on the outermost photoresist stripe increases to increase the adhesion strength of the photoresist, so that separation of the photoresist can be prevented.

Figure 5:
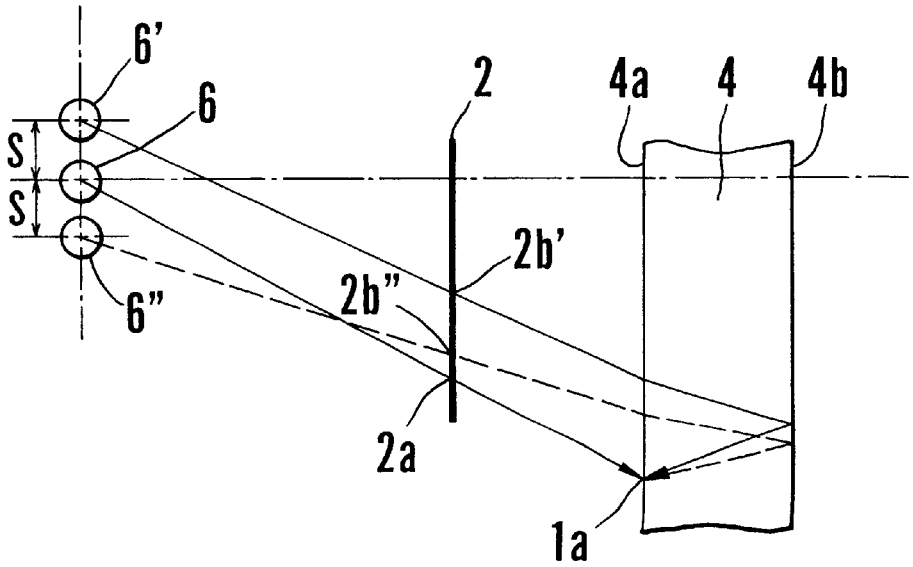
FIG. 5 is a schematic view for explaining an exposure method according to the present invention in which exposure light sources arranged at different positions are used.

Equations (11) and (12) are conditions required for causing two light beams emitted by the same light source 6 to coincide with each other, as shown in FIG. 4. Alternatively, as shown in FIG. 5, it is also possible to cause light which is emitted by a light source 6 corresponding to a certain emission color and becomes directly incident on the inner surface 4*a* of the panel 4, and light which is emitted by a light source 6' (or a light source 6") at a different position corresponding to another emission color, is reflected by the outer surface 4*b* of the panel 4, and is returned to the inner surface 4*a* of the panel 4, to coincide with each other.

A case wherein the radius of curvature of the shadow mask 2 and that of the glass panel 4 are positive infinity has been described. Even if the radii of curvature are finite, the necessary conditions can be calculated in the same manner. Also, the necessary conditions can be set by observation, without calculation, to satisfy the above relationship.

In the above explanation on the principle, of light emitted by the exposure light source 6 at a position corresponding to, e.g., a green photoresist corresponded 5, light which has passed through the outermost slot 2*a* and light which has passed through a slot inside the outermost slot by an integer multiple of one rpitch (N times) overlap each other on a green phosphor corresponded photoresist stripe. However, light which is emitted by an exposure light source at a position corresponding to a green phosphor corresponded photoresist may overlap a red or blue phosphor corresponded photoresist stripe, or light which is emitted by an exposure light source at a position corresponding to a red or blue photoresist may overlap the position of a red, blue, or green phosphor corresponded photoresist. Namely, the present invention can include any color combination. Since light beams which have passed through different slots are caused to become incident on the same position via different paths so that the adhesion strength of the photoresist at this position of incidence is increased, a desired photoresist stripe can be adhered without decreasing the adhesion strength of this portion and without causing separation.

Figure 6:
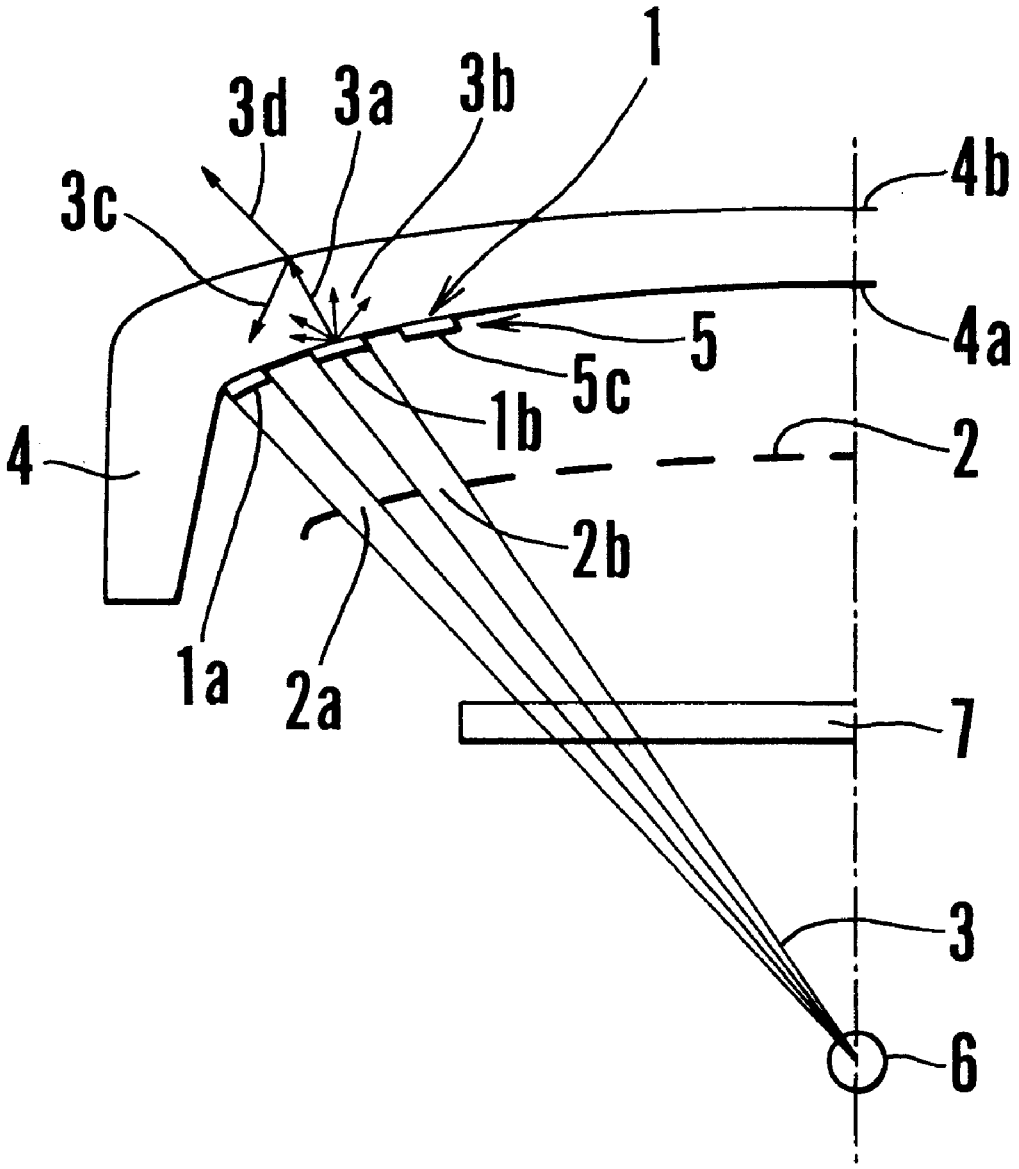
FIG. 6 is a schematic view for explaining an exposure method according to an embodiment of the present invention.

An embodiment of the present invention will be described with reference to FIG. 6. FIG. 6 shows an exposure light source 6, a filter 7 for adjusting the light intensity distribution, a shadow mask 2, and a panel 4. According to the present invention, when the gap (g) between the shadow mask 2 and panel 4, the distance (L) between the exposure light source 6 and panel 4, the thickness (t) of the panel 4, the refractive index (n) of the panel 4, the horizontal pitch (p) of all the slots of the shadow mask 2, the opening angle (θ) of the outermost slot 2*a* with respect to the center line, and the distance (L−g) between the exposure light source 6 and shadow mask 2 are appropriately selected, light which has passed through a slot inside the outermost slot of the shadow mask 2 can be caused to superpose on the position of the outermost photoresist stripe, as described above. In this embodiment, exposure is performed by an exposure light source located at a position (on the center line) corresponding to a green phosphor corresponded photoresist, and light, which has passed through a slot 2*b* inside the outermost slot of the shadow mask 2 by one slot, is caused to coincide with a portion where light, which has passed through the outermost slot 2*a* of the shadow mask 2, irradiates the outermost photoresist of the panel to fix it.

Light 3 emitted by the exposure light source 6 passes through the filter 7 and is directed toward the shadow mask 2. The central portion of the filter 7 has a decreased transmittance in order to ensure uniformity of the incident light. The light 3 which has passed through the shadow mask 2 travels straight up to an inner surface 4*a* of the panel 4 and is irradiated to the slurry layer of photoresists 5 containing a photosensitive material and applied on the inner surface 4*a* of the panel 4. The slots of the shadow mask 2 are vertically elongated. Since a light beam having a vertically elongated spot is irradiated to the photosensitive photoresist slurry accordingly, the slurry is photosensitized into the same shape as that of the shadow mask. The photosensitized portion is hardened and is fixed to the panel, so that a photoresist pattern which is identical to the pattern of the shadow mask 2 is formed as a hardened portion 5*c*. In practice, the patterns extending in the vertical direction overlap each other depending on the longitudinal size of the light source, and patterns photosensitized on the inner surface of the panel form continuous vertical stripes with respect to the slot pattern of the separated shadow mask. When the non-photosensitized portion is washed off by the "development" after exposure, a desired photoresist pattern can be obtained.

Light which has passed through an outermost slot 2*a* of the shadow mask 2 hardens a portion la of the slurry layer of the photoresists 5 applied on the inner surface 4*a* of the panel 4. Light which has passed through a slot 2*b* inside the slot 2*a* by one slot is similarly irradiated to a portion 1*b* of the slurry layer of the photoresists 5 to harden the photoresists 5. This latter light can be discussed separately as two light components, i.e., light 3*b* which becomes incident on the corresponding photoresist 5 and is diffused to become incident on the panel 4 or is reflected directly, and light 3*a* which travels straight to become incident on the panel 4. The light 3*b* which becomes incident on the panel 4 after diffusion has a small influence on the outermost stripe la due to diffusion. The light 3*a* which travels straight is refracted by the inner surface 4*a* of the panel 4, travels straight in the panel 4, and reaches an outer surface 4*b* of the panel 4 to form light 3*c* reflected by the outer surface 4*b* and light 3*d* which is refracted and guided outside the panel 4. The light 3*d* which is guided outside is not discussed in the present invention. Since the reflected light 3*c* returns to the phosphor-coated surface, it contributes to hardening of the photoresists 5. The reflected light 3*c* returns to a side close to the outermost photoresist stripe 1*a* of the inner surface 4*a* of the panel 4, but the return position is not defined conventionally. The present invention defines the various conditions such that the return light reliably coincides with the outermost stripe. For example, light passing through a slot inside the outermost slot by one slot will not incompletely overlap the outermost stripe to cause a shortage in light quantity. This return path is determined by the respective factors described earlier. If the distance to the light source is decreased, the position of incidence of the reflected light may be moved farther outward, and vise versa. In this manner, since the respective factors are selected such that the paths of two light components coincide with each other, light having a sufficient light quantity is directly irradiated to the adhesion surface between the slurry of the photosensitive photoresists 5, which are applied to the outermost portion, and the panel 4, and contributes to hardening of the photoresists 5 at this portion, thereby improving the adhesion strength.

This embodiment merely shows one case. It is a matter of course that the same effect can be obtained if light emitted by respective exposure positions corresponding to red, green, and blue phospher corresponded photoresists may concentrate to a photoresist stripe corresponding to one emission color, or to photoresists corresponding to different emission colors.

What we claim is:

1. An exposure method for a picture tube of exposing, through a shadow mask, photoresists, which are applied on an inner surface of a panel to fix said photoresists on said inner surface of said panel, comprising setting a position where light, which is emitted by an exposure light source and passes through an outermost slot of said shadow mask, becomes directly incident on said inner surface of said panel, to coincide with a position where light, which is emitted by an exposure light source at the same position as that of said first exposure light source or at a different position from that of said first exposure light source, passes through a slot inside said outermost slot of said shadow mask, is reflected by an outer surface of said panel, and returns, becomes incident on said inner surface of said panel.

2. A method according to claim 1, wherein said position where the direct light and reflected light become incident on said inner surface of said panel is on an outermost photoresist stripe.

3. An exposure apparatus for a picture tube in which a shadow mask is disposed between a panel, an inner surface of which is applied with photoresists, and an exposure light source, wherein a distance between said exposure light source and said inner surface of said panel, a gap between said shadow mask and said inner surface of said panel, a thickness of said panel, a refractive index of said panel, a horizontal pitch of said shadow mask, an opening angle of an outermost slot of said shadow mask with respect to a central axis connecting said exposure light source and a center of said panel, and the number, when counted from said outermost slot, of slots inside said outermost slot are set to satisfy a predetermined relationship, so that light which has passed through said outermost slot of said shadow mask and light which passes through said slot inside said outermost slot, is reflected by an outer surface of said panel, and returns, are set to coincide with each other on a position on said inner surface of said panel.

4. An apparatus according to claim 3, wherein said exposure light source, said shadow mask, and said panel are disposed to satisfy:

$$Np = \left\{2(L-g)t / L\sqrt{n^2 - \sin^2\theta_0}\right\}\sin\theta_0$$

$$\text{and } \theta_0 = \tan^{-1}\{\{(L-g)\tan\theta - Np\}/(L-g)\}$$

where L is the distance between said exposure light source and said inner surface of said panel, g is the gap between said shadow mask and said inner surface of said panel, t is the thickness of said panel, n is the refractive index of said panel, p is the horizontal pitch of slots of said shadow mask, θ is the opening angle of said outermost slot of said shadow mask with respect to said central axis connecting said exposure light source and said center of said panel, and N is the number, when counted from said outermost slot, of slots inside said outermost slot.

* * * * *

UNITED STATES PATENT AND TRADEMARK OFFICE

CERTIFICATE OF CORRECTION

PATENT NO.: 6,091,191
DATED: July 18, 2000
INVENTOR(S): Masaru TOGAWA

It is certified that error appears in the above-identified patent and that said Letters Patent is hereby corrected as shown below:

Column 5, line 25, delete "$\theta_o$" insert --$\theta_1$--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*